US008661986B2

(12) United States Patent
Schmidt

(10) Patent No.: US 8,661,986 B2
(45) Date of Patent: Mar. 4, 2014

(54) COASTER DESIGN

(75) Inventor: Jordan M. Schmidt, Westwood, NJ (US)

(73) Assignee: Becher-Schmidt USA, Westwood, NJ (US)

( * ) Notice: Subject to any disclaimer, the term of this patent is extended or adjusted under 35 U.S.C. 154(b) by 164 days.

(21) Appl. No.: 13/214,826

(22) Filed: Aug. 22, 2011

(65) Prior Publication Data

US 2012/0042802 A1 Feb. 23, 2012

Related U.S. Application Data

(60) Provisional application No. 61/376,075, filed on Aug. 23, 2010.

(51) Int. Cl.
*A63G 1/00* (2006.01)

(52) U.S. Cl.
USPC ..... 104/57

(58) Field of Classification Search
USPC ..... 104/53, 56, 57, 63, 67, 86; 414/358
See application file for complete search history.

(56) References Cited

U.S. PATENT DOCUMENTS 5,046,912 A * 9/1991 Bostrom et al. ..... 414/358

* cited by examiner

*Primary Examiner* — R. J. McCarry, Jr.
(74) *Attorney, Agent, or Firm* — Tutunjian & Bitetto, P.C.

(57) ABSTRACT

A coaster having a substantially cylindrical rotatable track area capable of rotating, for example, 180° and repositioning a car for further movement along another track different than the one from which it originated. The rotatable track area can be cylindrical or frusto-conical in configuration. A corresponding rotation system with computer controls can selectively rotate the rotatable track area in predetermined increments according to the coaster track end positions so as to selectively align the rotatable tracks with the coaster tracks.

9 Claims, 11 Drawing Sheets

COASTER DESIGN

CROSS REFERENCE TO RELATED APPLICATIONS

This application claims priority of U.S. Provisional Patent Application Ser. No. 61/376,075 filed on Aug. 23, 2010.

BACKGROUND

1. Technical Field

The present invention relates to roller coasters. More particularly, it relates to a rotatable track area for implementation in a roller coaster.

2. Description of the Related Art

Currently coasters provide various tricks and features to make the ride more exciting. Examples of these various tricks include loops, heart-line rolls, and steep inclines and declines to add to the enjoyment of the ride.

To date, however, there are no known coasters that implement a track area with an integrated rotation system.

SUMMARY OF THE INVENTION

A rotatable track area having a rotatable portion, a drive system for selectively rotating the rotatable portion from 0-360°, with the ability to incrementally rotate the same (e.g., 90°, 180°, 270° and 360°). One or more coaster tracks are positioned on the rotatable portion and configured to be aligned with one or more tracks in the corresponding coaster. Those of skill in the art will recognize that the angular rotation increments of the rotatable track area can be changed and are not limited to 90 degree increments.

According to one implementation, the rotatable portion is cylindrical in configuration. According to another implementation, the rotatable portion is frusto-conical in configuration.

Other aspects and features of the present principles will become apparent from the following detailed description considered in conjunction with the accompanying drawings. It is to be understood, however, that the drawings are designed solely for purposes of illustration and not as a definition of the limits of the present principles, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

In the drawings wherein like reference numerals denote similar components throughout the views.

DETAILED DESCRIPTION OF PREFERRED EMBODIMENTS

Figure 1:
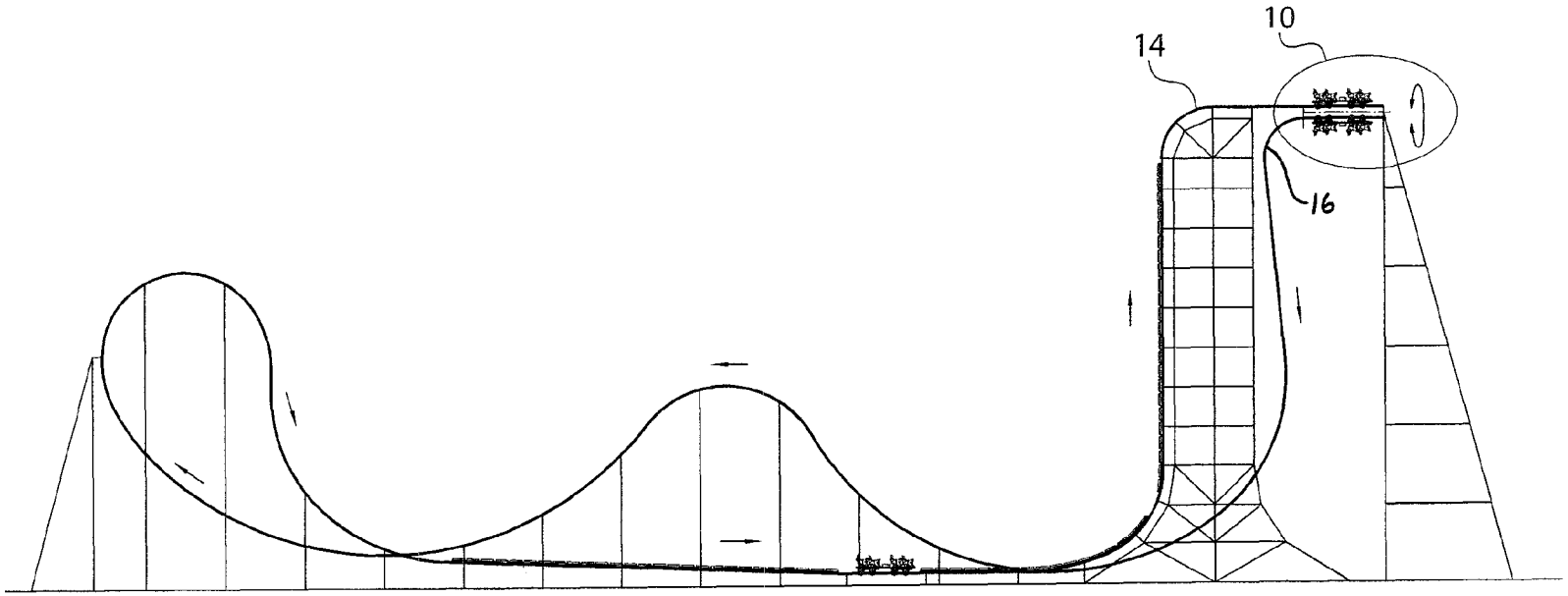
FIG. 1 is an overview of a coaster having a rotatable track area according to an implementation of the present principles.
Figure 1A:
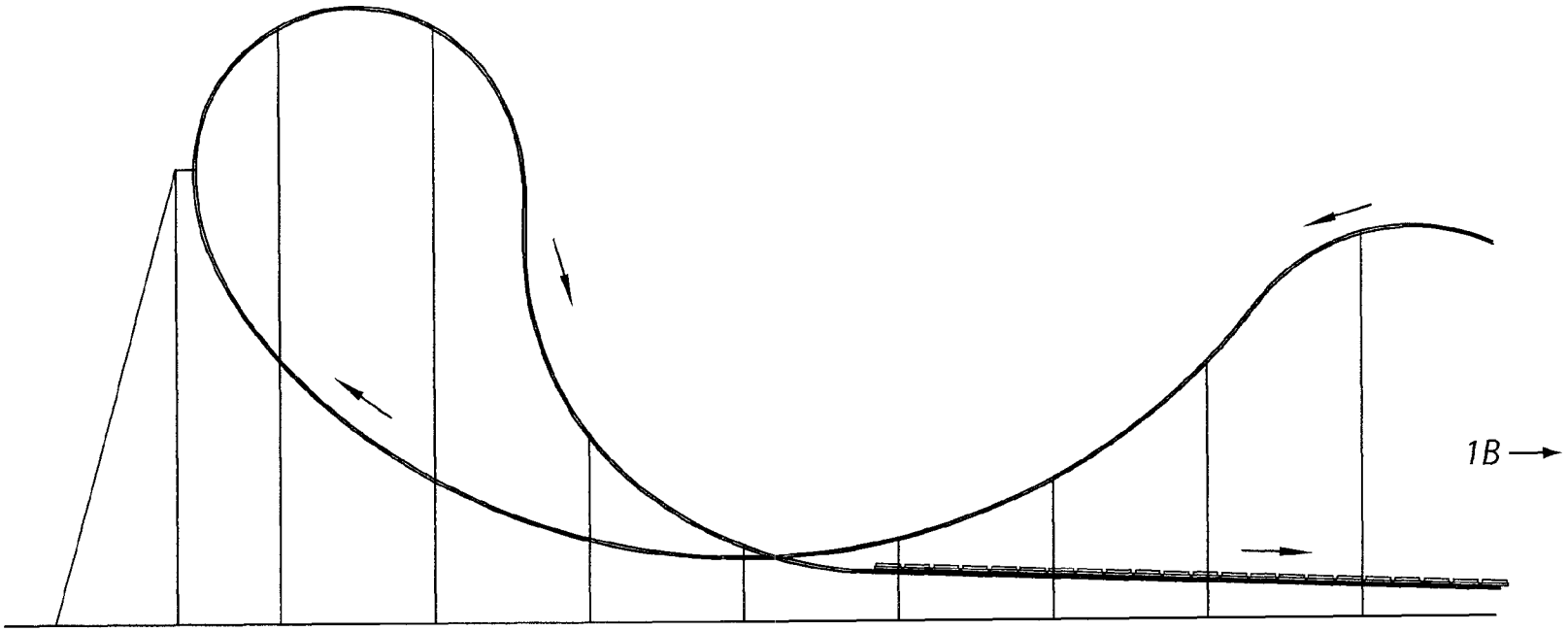
FIGS. 1A and 1B show an enlarged view of the coaster shown in FIG. 1.
Figure 1B:
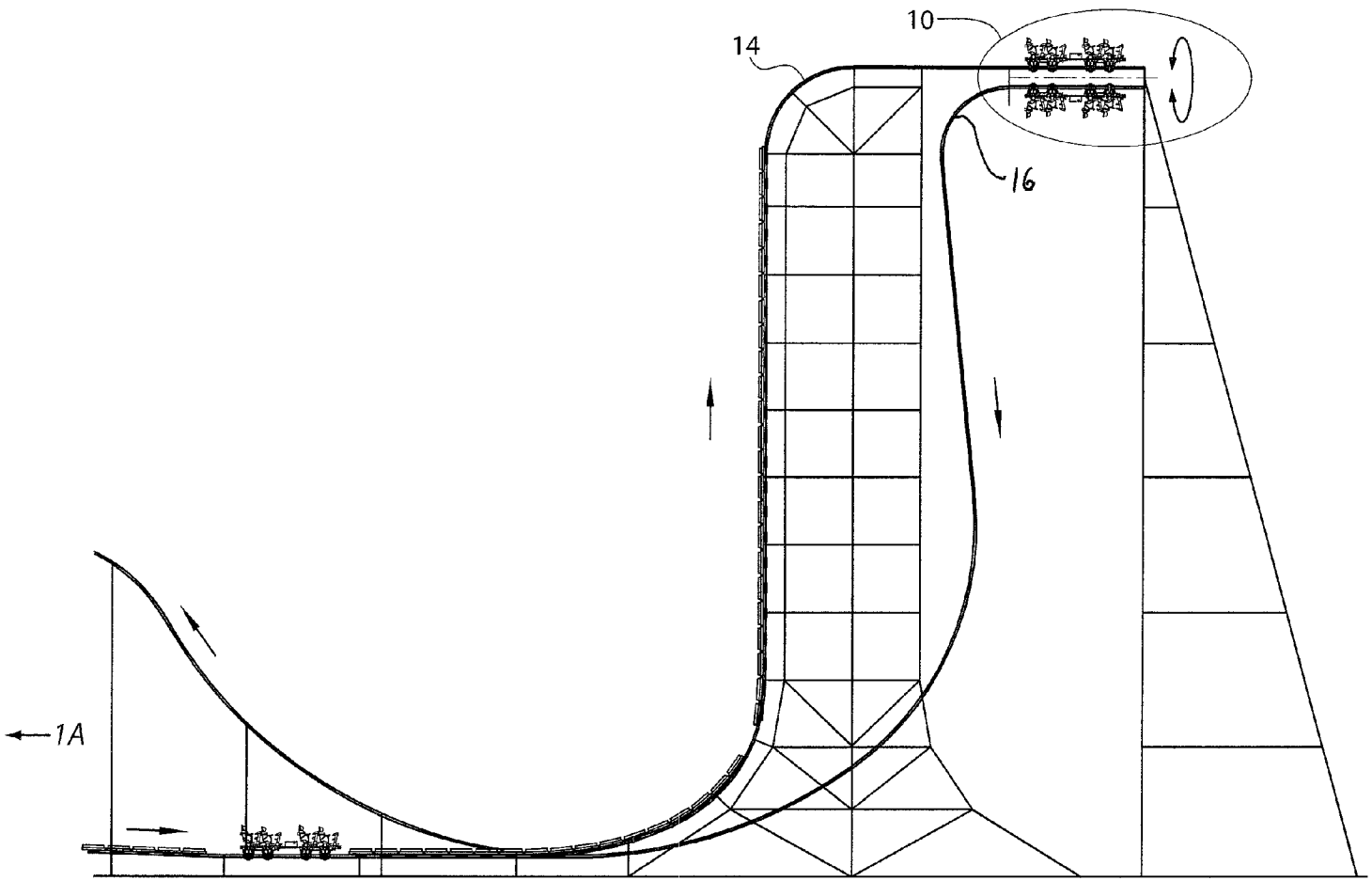
Figure 4A:
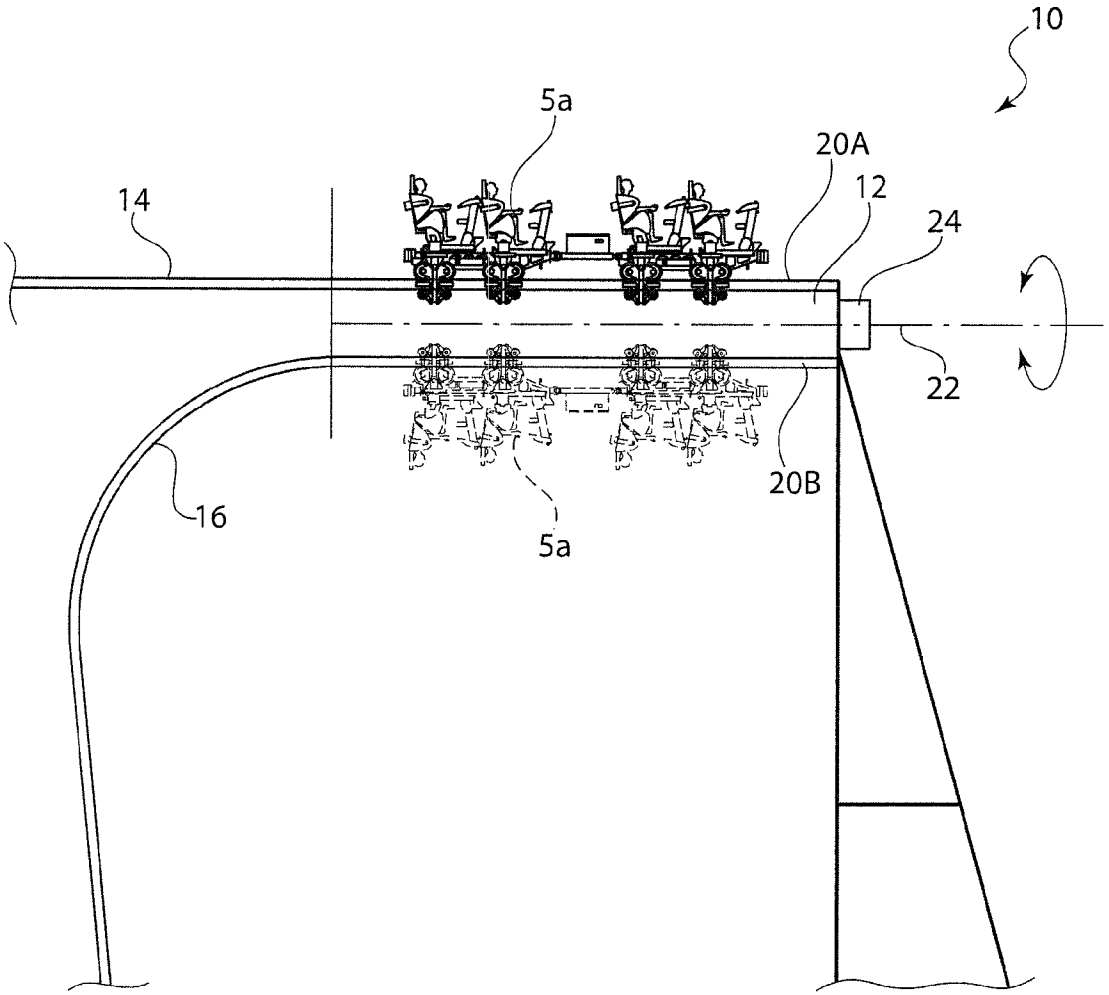
FIG. 4A is an enlarged view of the rotatable track area according to one implementation of the present principles.

FIG. 1 shows a coaster having a rotatable track area or portion indicated generally by 10. FIGS. 1*a* and 1*b* show an enlarged view of the track of FIG. 1. Referring to FIG. 4A, and according to one implementation of the invention, the rotatable track area 10 includes a rotatable cylinder 12 that has an axis of rotation 22, and is rotated by a system 24 connected to the same.

As will be evident from the following description, the present invention is not intended to be limited to the use of one track on the rotation system, and can be configured to include more tracks depending on the desired implementation, and the rotation of the same.

The rotation system 24 can be any suitable known system such as, for example, a gear drive system with one or more motors and corresponding gears, or a belt driven system with one or more belts and one or motors. Those of ordinary skill in the art will recognize that a corresponding computer control will be included with rotation system 24 to allow for the implementation of necessary safety and operational controls of the cylinder rotation. In addition, the location of the rotation system can be external to the rotatable cylinder 12 or internal to the same depending on the desired application, while the computer controls would most likely be located in an area more easily accessible for operate control than the rotation system 24. Obviously the locations of the computer control would be a matter of design choice and may change from coaster to coaster depending on the respective design.

According to the disclosed embodiments, cylinder 12 can include one track 20 (FIGS. 4D and 4E), two tracks 20A and 26 (FIGS. 4B and 4C) situated as shown, or more tracks depending on the desired application.

In the exemplary embodiment shown in FIG. 4A, the cylinder 12 includes a track 20 which is configured to align with the upper track 14 of the coaster. When the car 5*a* leaves track 14 and it enters track 20 such that the car 5*a* is completely positioned on the cylinder 12. Once so positioned, the car 5*a* is locked (e.g., magnetically locked) into place on the track 20 (either via the track, or other magnetic securing means) and the rotation system 24 can then be activated. The rotation system rotates cylinder 12 around axis 22 a half turn (180°) such that the car 5*a* is positioned upside down and track 20A is now aligned with lower track 16. In this position, the magnetic lock can be released to allow car 5*a* can proceed down track 16.

In accordance with one implementation, the axis of rotation 22 is parallel with the one or more tracks (e.g., 14, 16) from which cars are received and/or loaded.

According to other implementations, two cars 5 and 6 (FIGS. 4B, 4C) can be used and cylinder 12 is equipped with two tracks 20 and 26. Those of skill in the art will recognize that a large enough cylinder 12 could accommodate more than two tracks. According to the implementation shown in FIG. 4B, the upper car 5 can be received onto track 20 while a lower car 6 (in dotted configuration) is received on track 26. Both cars 5 and 6 are magnetically locked and rotation system 24 is actuated to rotate cylinder 180 degrees and switch the positions of tracks 20 and 26 with respect to tracks 14 and 16, and thereby cars 5 and 6. The ride then continues.

Figure 2:
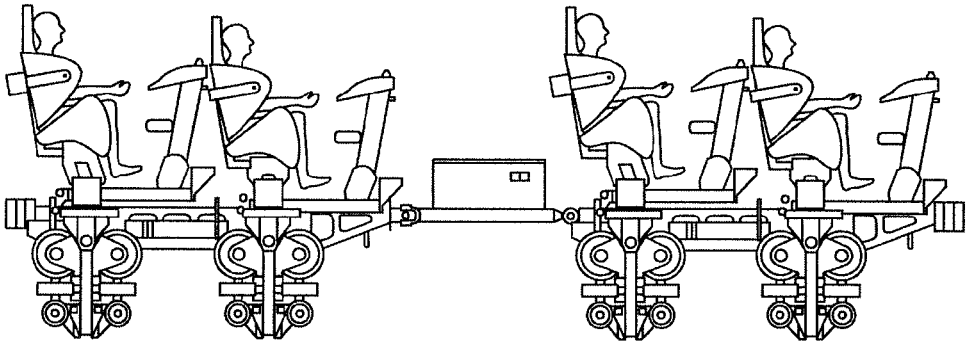
FIGS. 2 and 3 show various car arrangements that could be used with the rotatable track of the present invention.
Figure 3:
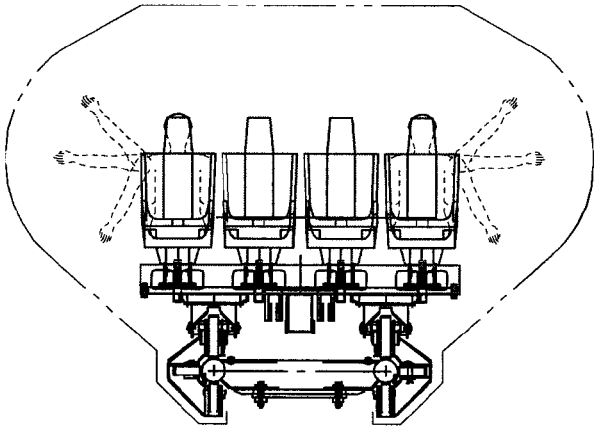
Figure 4B:
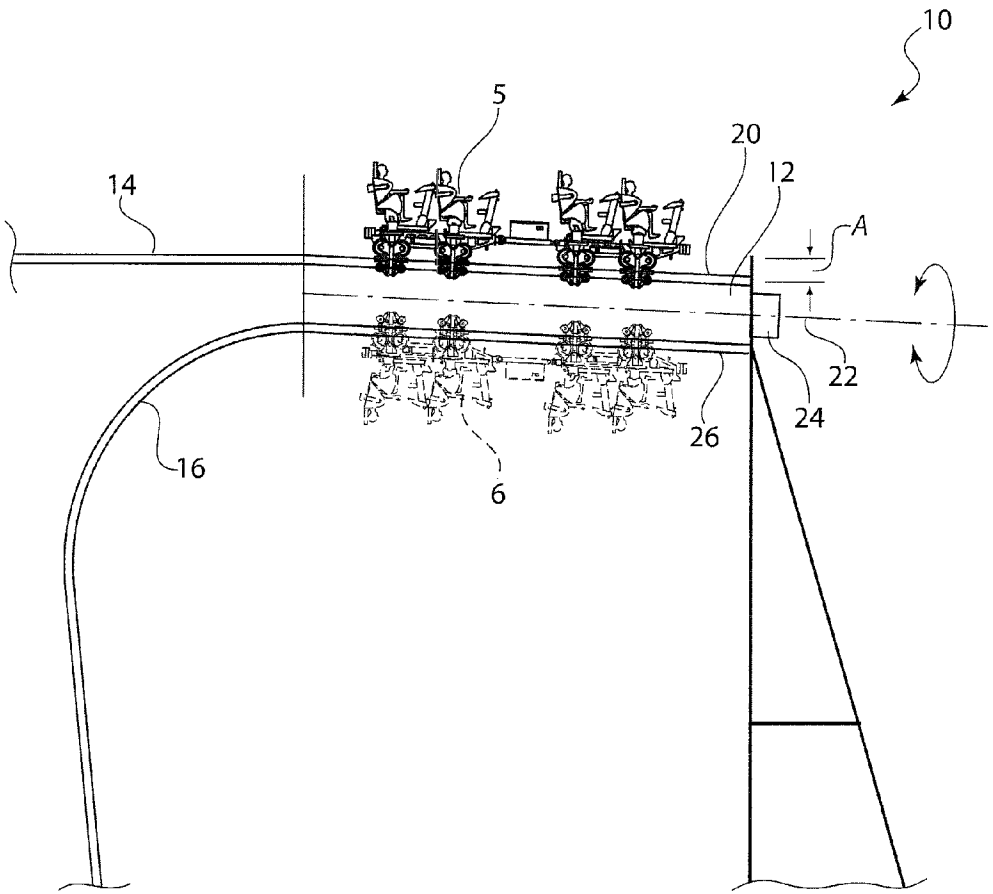
FIG. 4B is an enlarged view of the rotatable track area according to another implementation of the present principles.

According to one proposed implementation shown in FIG. 4B, cylinder 12 is slightly angularly positioned downward with respect to upper track 14 and lower track 16. This slight angular displacement A can be in a range of 0°-5°. With this slight downward angular displacement A, when car 5 is positioned on track 20, the magnetic lock could be released and the car 5 will stay on the track 20 (due to gravity) until it is either activated (e.g., by magnetic propulsion or rotated on cylinder 12 to be repositioned for release onto lower track 16.). In addition, in the instance when there is one track 20 on the cylinder 12 (show in FIG. 2*a*), the downward angular displacement would allow car 5*a* to remain biased toward the end of cylinder 12 opposite the lower track 16.

Figure 4C:
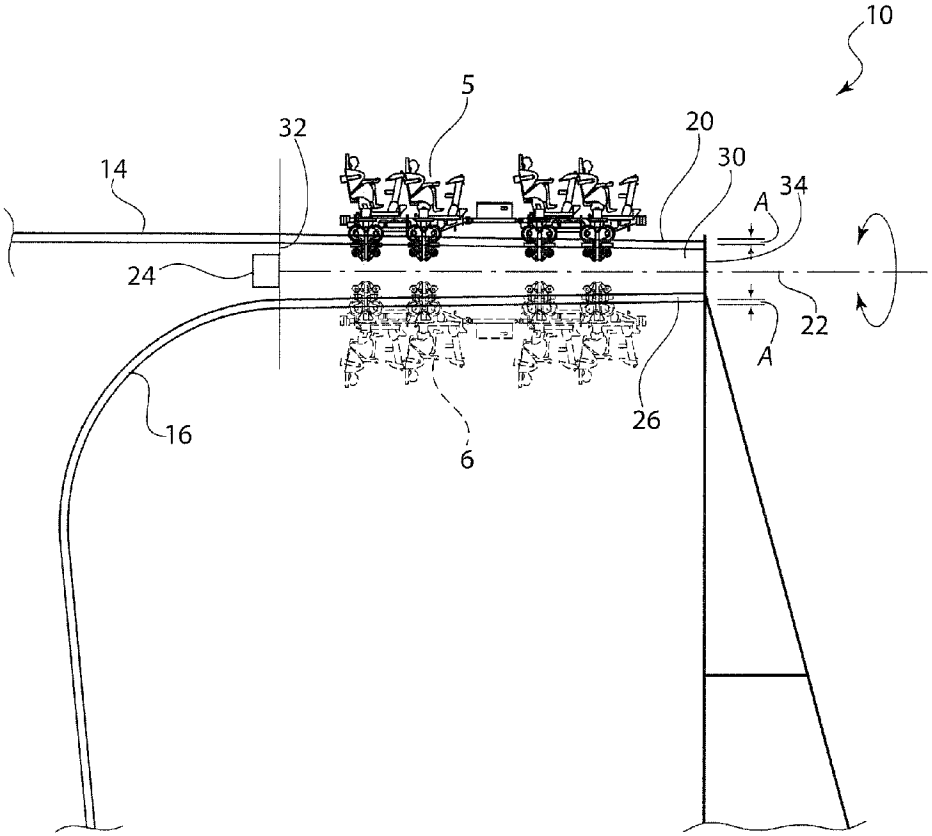
FIG. 4C is an enlarged view of the rotatable track area according to yet another implementation of the present principles.

According to yet another implementation shown in FIG. 4C, a frusto-conical portion 30 is provided in place of cylinder 12 where the tracks 20 and 26 are angularly displaced from a horizontal/parallel relation with the center rotation axis 22 by an angle A as shown. As shown, the rotatable section 30 has one end 32 that is slightly larger than the opposing end 34. In this implementation, the rotation system 24 can be positioned on the larger side 32 of rotatable portion 30, however the position of rotation system 24 is a matter of design choice and can be implemented on either side or internal to the rotatable portion 30 (and 12 in the prior exemplary embodiments). In the embodiment of FIG. 4C, car 5 on track 20 can have its magnetic locks released without concern that the car will roll back down track 14. At the same time, when the magnetic locks are released on car 6, the car will be capable of rolling into action and onto track 16 as a result of the angular displacement A (i.e., due to gravity).

Figure 4D:
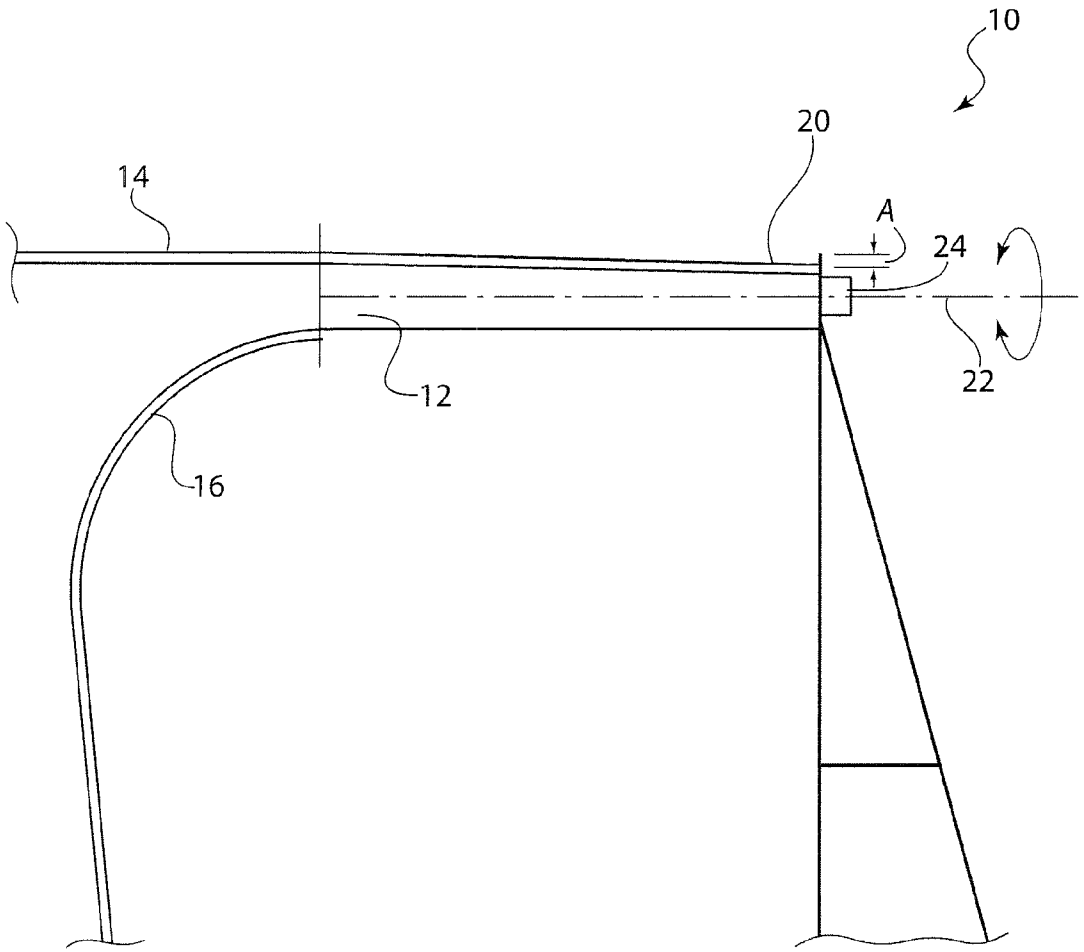
FIG. 4D is an enlarged view of the rotatable track area design according to another implementation of the present principles.
Figure 4E:
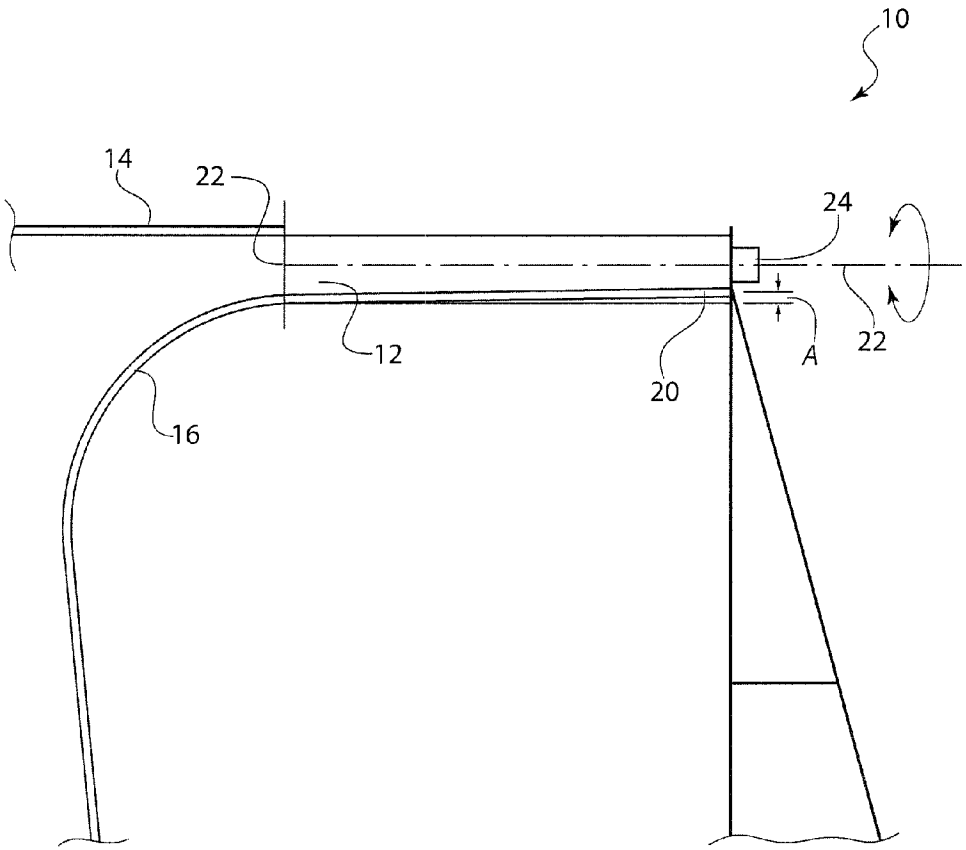
FIG. 4E is an enlarged view of the rotatable track design of FIG. 4*d* with the track rotated 180 degrees.

FIGS. 4D and 4E show another implementation where there is one track 20 mounted on the rotating cylinder 12 having the angular displacement A, and thus the track is positioned at the same angle A in a range of 0°-5° as shown. Thus, when a car is received from track 14 and locked onto track 20, cylinder 12 is then rotated 180°, and track 20 is now angularly positioned to cause the car to roll off the same onto corresponding track 16. As will be prevalent from the Figures, the track 20 can be angularly displaced with respect to the center axis 22 or the outer circumference of the cylinder 12, while maintaining the substantially cylindrical shape of cylinder 12.

In accordance with other implementations, the angular displacements discussed above could be configured into the rotating cylinder (e.g., recessed into it) so the outer circumference of the cylinder is consistent throughout the same.

Figure 5:
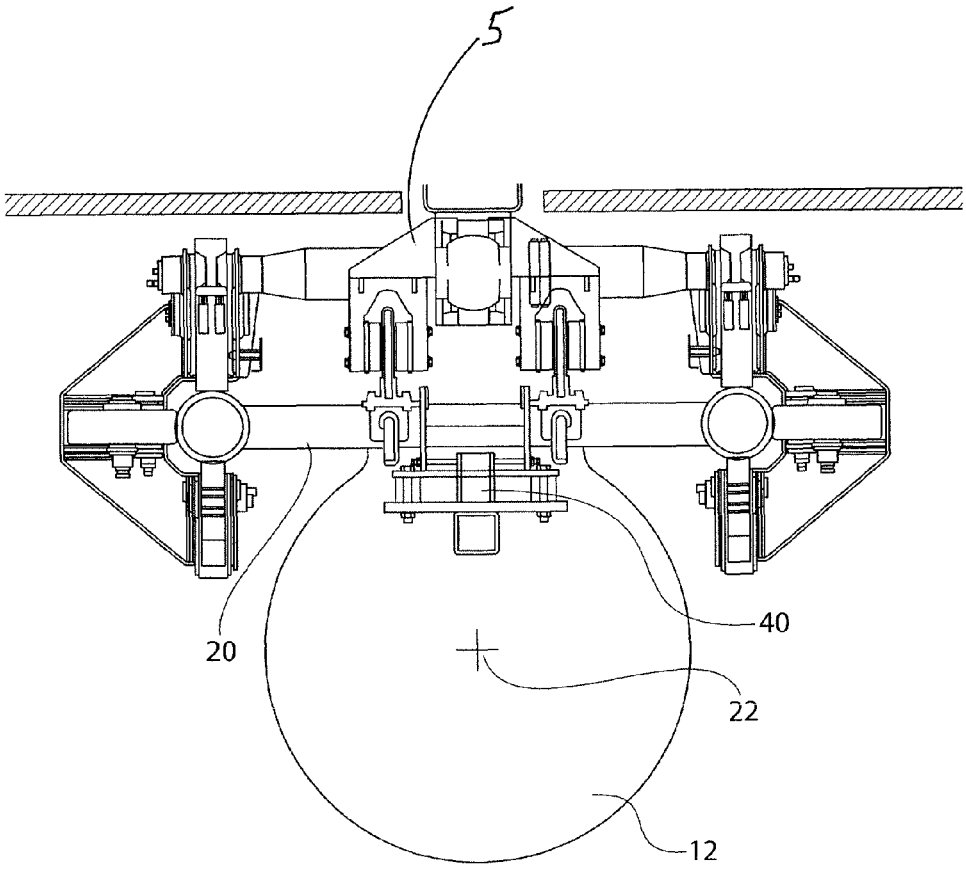
FIG. 5 is a side view of the rotatable track area design according to an implementation of the present principles.
Figure 6:
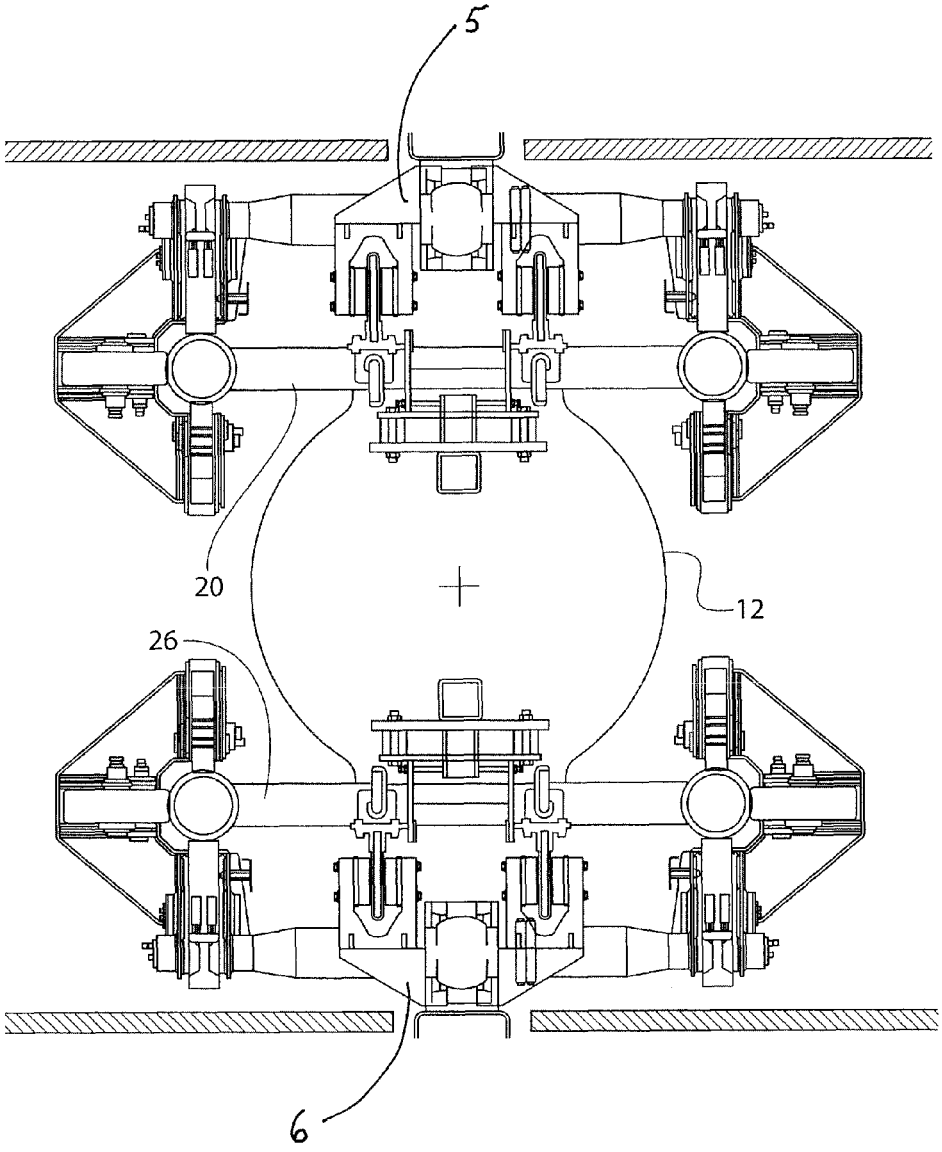
FIG. 6 is a side view of the rotatable track area design according to another implementation of the present principles.

FIG. 5 shows a side view of the rotatable cylinder 12 showing the track 20 positioned thereon. Those of skill in the art will recognized that cylinder 12 will include the appropriate accommodations to receive the magnetic drive assembly 40 of the corresponding car riding along track 20. FIG. 6 shows another side view where the two tracks 20 and 26 are positioned on the rotatable portion 12 or 30 according to the disclosed implementations.

In accordance with other contemplated implementations, it is possible that the rotating track portion 12 is implemented between other sets of tracks and does not operate as an end of the track as shown and described above. In this implementation, it is envisioned the cars could be rerouted to different tracks in the coaster to provide different ride effects or experiences.

While there have been shown, described and pointed out fundamental novel features of the present principles, it will be understood that various omissions, substitutions and changes in the form and details of the methods described and devices illustrated, and in their operation, may be made by those skilled in the art without departing from the spirit of the same. For example, it is expressly intended that all combinations of those elements and/or method steps which perform substantially the same function in substantially the same way to achieve the same results are within the scope of the present principles. Moreover, it should be recognized that structures and/or elements and/or method steps shown and/or described in connection with any disclosed form or implementation of the present principles may be incorporated in any other disclosed, described or suggested form or implementation as a general matter of design choice. It is the intention, therefore, to be limited only as indicated by the scope of the claims appended hereto.

What is claimed is:

1. A coaster comprising:

a rotatable track area having a substantially cylindrical rotatable portion capable of rotating about an axis; and at least one track positioned on an outer periphery of the rotatable portion;

wherein selective rotation of the rotatable portion positions the at least one track on the outer periphery in alignment with one or more tracks of the coaster.

2. The coaster of claim 1, further comprising a rotation system connected to the rotatable portion and configured to selectively rotate the same in predetermined increments.

3. The coaster of claim 1, wherein the rotatable portion comprises a cylinder.

4. The coaster of claim 1, wherein cylinder is configured such that the at least one track positioned thereon is angularly displaced from the one or more tracks of the coaster in a range of 0.1-5.0 degrees.

5. A coaster comprising:

a coaster track having two ends terminating at the same point and being displaced from each other;

a rotatable track area positioned at the termination point of the two ends of the track, the rotatable track area further comprising:

a cylindrical rotatable portion capable of rotating about an axis; and at least one track positioned on an outer periphery of the rotatable portion;

wherein selective rotation of the cylindrical rotatable portion positions the at least one track on the outer periphery in alignment with at least one of the two ends of the coaster track.

6. The coaster of claim 5, further comprising a rotation system connected to the rotatable portion and configured to selectively rotate the same in predetermined increments.

7. The coaster of claim 5, wherein at least one track positioned on the rotatable portion comprises two tracks such that the selective rotation of the cylindrical portion positions both tracks with each of a respective end of the coaster track.

8. The coaster of claim 5, wherein the ends of the coaster track are displaced from each other by at least 90 degrees with respect to the rotation axis of the rotatable portion.

9. The coaster of claim 5, wherein cylinder is configured such that the at least one track positioned thereon is angularly displaced from the at least one of the two ends of the coaster track in a range of 0.1-5.0 degrees.

* * * * *